US009883724B2

(12) United States Patent
Woode

(10) Patent No.: US 9,883,724 B2
(45) Date of Patent: Feb. 6, 2018

(54) STORAGE INSERT FOR TRAVEL SUITCASE

(71) Applicant: Denita Woode, Brooklyn, NY (US)

(72) Inventor: Denita Woode, Brooklyn, NY (US)

( * ) Notice: Subject to any disclaimer, the term of this patent is extended or adjusted under 35 U.S.C. 154(b) by 0 days.

(21) Appl. No.: 14/997,614

(22) Filed: Jan. 18, 2016

(65) Prior Publication Data

US 2017/0202328 A1 Jul. 20, 2017

(51) Int. Cl.
*A45C 13/02* (2006.01)
*A45C 5/03* (2006.01)

(52) U.S. Cl.
CPC ..... *A45C 13/02* (2013.01); *A45C 5/03* (2013.01); *A45C 2013/026* (2013.01)

(58) Field of Classification Search
CPC ..... A45C 13/02; A45C 13/005
USPC ..... 206/561; 190/35, 108–110, 118; 220/527; 150/113
See application file for complete search history.

(56) References Cited

U.S. PATENT DOCUMENTS 4,699,267 A 10/1987 Burke
5,160,060 A * 11/1992 Garofalo, Jr. ..... E05B 17/2057 220/318
5,174,452 A 12/1992 Wang
5,394,913 A * 3/1995 Zezza, Jr. ..... A45C 13/005 150/118
5,873,504 A * 2/1999 Farmer ..... A45C 3/00 150/113
6,272,978 B1 * 8/2001 Westbrooks ..... A21B 5/026 99/383
6,454,097 B1 * 9/2002 Blanco ..... A45C 3/02 206/459.5
6,543,387 B1 * 4/2003 Stein ..... A01K 1/0245 119/419
7,540,378 B2 6/2009 Gallagher
8,689,979 B2 * 4/2014 Rowe ..... A47G 21/14 206/553
2006/0219580 A1 * 10/2006 Lown ..... A47B 3/0912 206/225
2006/0283869 A1 * 12/2006 Soncini ..... A45C 11/04 220/836
2009/0045030 A1 * 2/2009 Peart ..... G07G 1/0027 194/206
2009/0294237 A1 * 12/2009 Sisitsky ..... A45C 1/024 190/103
2011/0147152 A1 6/2011 Abdill
2012/0118838 A1 5/2012 Gutierrez
2014/0230975 A1 * 8/2014 Groover ..... A45C 1/024 150/112
2015/0136718 A1 * 5/2015 Sabounjian ..... A47J 31/3642 211/85.4

FOREIGN PATENT DOCUMENTS

WO 9930589 A1 6/1999

OTHER PUBLICATIONS

"Stack-on13-Compartment Storage Box-SBR-13" at Home Depot, http://www.homedepot.com/p/qv/204065028, Apr. 2014.

(Continued)

*Primary Examiner* — Sue A Weaver
(74) *Attorney, Agent, or Firm* — James G. Passé; Passé Intellectual Property, LLC

(57) ABSTRACT

The present invention is a solid insert device for use inside a suitcase, especially a soft shell suitcase. By filling it sized to the suitcase, maximum use of the suitcase insert is achieved.

19 Claims, 5 Drawing Sheets

(56) References Cited

OTHER PUBLICATIONS

"Keter Master Pro 24-1/4in. Utility Cart", at Home Depot, http://www.homedepot.com/p/Keter-Master-Pro-24-1-4-in-Utility-Cart-197481/204513596, Apr. 2014.

* cited by examiner

STORAGE INSERT FOR TRAVEL SUITCASE

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

Field of the Invention

The present invention relates to a travel container. In particular it relates to an improved travel container designed to maximize packing and fit inside a suitcase or other similar travel container.

Description of Related Art

The number and shapes of suitcases has declined as airlines dictate the size of suitcases they will take and the sizes that fit in overhead bins. The general standardization of such suitcases means the inner dimensions and general shapes can be seen to repeat amongst the various brands of suitcases. These days most suitcases have straight sides and rounded corners. In addition, the use of soft-shell cloth type cases has taken favor over the old hard-shell cases. While for clothing and other soft items the impact of things hitting the case does little, if any damage, more fragile items, like shoes, electronics, and the like, are far more apt to be damaged in a soft-shell type suitcase.

Hard plastic cases and soft leather or cloth cases are well known to be available for storing and transporting virtually anything. And there are literally hundreds, if not thousands, of styles and sizes of hard plastic storage containers available from hardware stores, fishing stores and container stores. Typically, when storage containers are used in a suitcase, they are fitted as best as can be and tend to waste a lot of space, and they can be difficult to deal with because of their general design flaws. There is nothing available that is designed for use inside a suitcase, both from a position of ease of use and being easily fitted and removed from a suitcase.

BRIEF SUMMARY OF THE INVENTION

The present invention relates to a case for inserting into a suitcase that is the same general dimensions as the inside of the suitcase, included are a bigger lid, rounded corners, and other features as well as can be seen in the detailed drawings. Accordingly, in one embodiment there is a container insert for use inside a suitcase that has an inside depth and also has an inside length, width, and corner shape defining an open top perimeter, the container insert comprising:

a) a rectangular container portion having a bottom and having a length and width side walls and a corner shape which define an open top perimeter the container made of a rigid polymer material and further comprising:
   i. a pair of handles pivotally mounted to opposite side walls; and
   ii. receiving slots on an inside surface of the side walls for removably receiving a divider panel; and b) the rectangular container lid portion having a length and a width and a corner shape that matches the open top perimeter of the container and further comprises: a pivotal hinge which traverses the width of the lid portion wherein the lid removably mounts on the container portion using a lid mount adapted to receive the pivotal hinge;

c) at least one divider panel for positioning in the receiving slots.

DETAILED DESCRIPTION OF THE INVENTION

Figure 1:
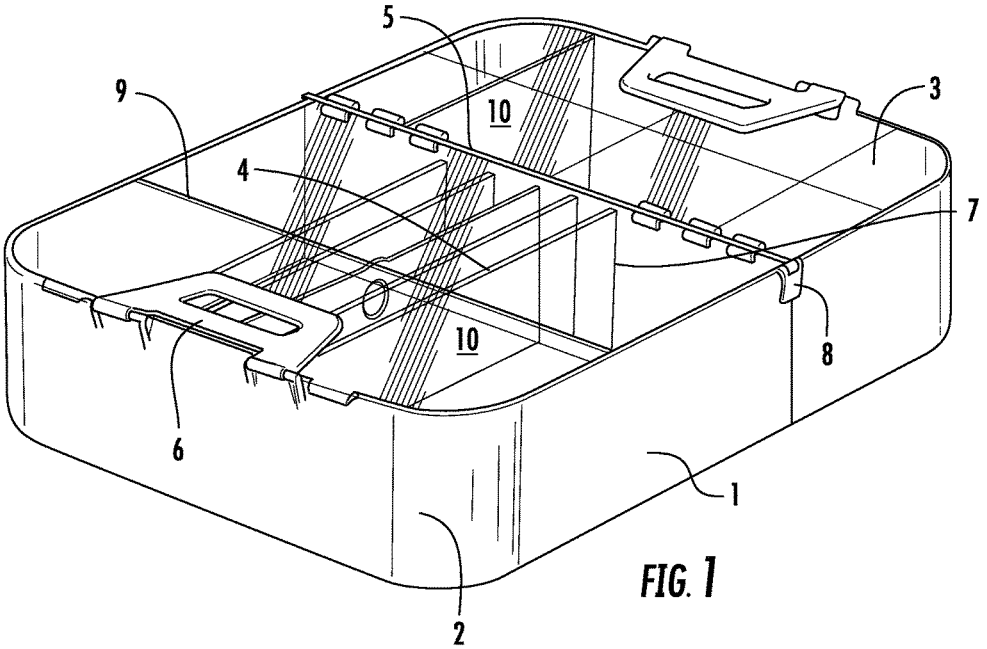
FIG. 1 is a perspective view of the container insert.

While this invention is susceptible to embodiment in many different forms, there is shown in the drawings, and will herein be described in detail, specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

DEFINITIONS

The terms "about" and "essentially" mean ±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

Reference throughout this document to "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are for the purpose of illustrating certain convenient embodiments of the present invention, and are not to be considered as limitations thereto. The term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein the term "container insert" refers to a container having a lid, designed to be used inside a suitcase. The container and the lid will be manufactured of a rigid polymeric material. In one embodiment, the polymer is a polycarbonate material. Other polymers are well known for manufacturing containers which could be used inside a suitcase and be compatible with the normal contents of a suitcase. The polymer can be colored or, in one embodiment, can be transparent allowing for viewing the contents. In one embodiment the lid is transparent. In one embodiment the suitcase will have an inside depth, and also have an inside length, width and corner shaped defining an open top perimeter. In one embodiment, the perimeter is as shown in the figures, namely straight sides and rounded corners as found in many modern suitcases. In one embodiment the open top perimeter of the container portion is the same shape as the open top perimeter of the suitcase and the container insert has an outside depth equal or less than the inside depth of the suitcase. It is also wherein the container insert fits inside the suitcase with no more than about one inch of clearance between any inside wall of the suitcase and an adjacent outside wall of the container insert, when the container insert is centered inside the suitcase. Of course, other shapes are to be considered and within the skill in the art in view of this disclosure.

As used herein the term "suitcase" refers to any kind of container designed as a travel container for clothing and personal items for use in airplanes, or other similar type travel situations. While the term suitcases is used throughout the application, the term is not meant to be limiting and should be understand to encompass any similar types of travel containers.

As used herein the term "rectangular container portion" refers to the container portion of the container insert of the present invention. It has a bottom, and has a length and width, side walls and a corner shape which define an open top perimeter. It generally will be of a depth such that, along with the lid, it fits inside a given suitcase so it can just fit in the suitcase depth-wise, or be some portion of the depth, allowing for other items to be in the suitcase. In one embodiment, the open top perimeter of the container portion is the same shape as the open top perimeter of the suitcase it's being used in, only just slightly smaller, so that it fits inside the suitcase (as seen in the examples in the figures). In one embodiment the container insert fits inside the suitcase with no more than one inch clearance between any inside wall of the suitcase and an adjacent outside wall of the container insert when the container insert is centered inside the suitcase. The clearance can be less than one inch and be from zero clearance to about one inch.

As used herein the term "pair of handles" refers to pivotally mounted handles mounted on opposite sides of the container portion. In one embodiment they are mounted on opposite widths. They are pivotal and, in one embodiment, can be folded down on the lid and hold the lid in place, or at least aid in holding down the lid. In the upright position, the handles can be utilized to pull or raise the container insert out of a suitcase.

As used herein, the term "divider panels" and "receiving slots" refers to divider panels of the normal type found in many containers, when the divider can be positioned in a number of positions to create compartments within the container portion. Such construction is within the skill in the art. The dividers, in one embodiment, have a bump on the top, as shown in the figures, to help support the lid when in the closed position. In another embodiment, the divider has a tab on a bottom edge which snap fits into a hole in the bottom of the container portion. In one embodiment there are three small gaps where the sides and bottom of the container portion meet, which are shaped to accept a divider removably for storage in at least one position of lying flat and standing vertical in the container portion.

As used herein the term "rectangular container lid portion" refers to a lid designed to fit on the rectangular container portion. The lid portion has a length and a width and a corner shape that matches the open top perimeter of the container portion and is designed to form a closed container when used on the container portion. The lid further comprises a pivotal hinge which traverses the width of the lid portion, wherein the lid removably mounts on the container using a lid mount adapted to receive the pivotal hinge. The lid, in one embodiment, is made transparent in order for the user to see the contents inside the container insert. As shown in the figures, having a hinge means that the lid can open on one side or the other to access the items on the individual sides of the container without disturbing items in the other side of the container. The lid can have additional (one or more) hinges to the one using the lid mount.

As used herein the term "rigid polymer material" refers to those plastics that are useful in make a hard shell type case. Included are polymers such as polycarbonate which have the advantage of being made clear so that the lid portion is clear and the contents can be seen. Other rigid polymers for case material are well known in the art.

As used herein the term "pair of handles" refers to handles on the short sides of the rectangular container that can be folded over to help lock down the lid on the case. The handles can be rigid polymer or any other polymer normally used for case handles.

As used herein the term "receiving slots" refers to vertical slots on the inside surface of the side walls (the long or short walls of the rectangular configuration) adapted to take a planar divider panel as shown in the Figures. Dividers can also have a tab on the bottom edge which snap fits into a hole in the bottom of the container. In one embodiment there are three (more or less) small gaps where the sides and bottom of the container portion meet, that is shaped to accept a divider removably in at least one position of lying flat and standing vertical in the container. An embodiment of this is shown in the Figures. The dividers can, in one embodiment, have a bump on a top edge of the divider to support the lid when the divider is being used and the lid is closed on the divider. This is shown in one embodiment in the Figures.

As used herein the term "lid mount" refers to a piece that fits across the width of the container portion and receives two pieces of the lid to form a hinge. The lid mount is mounted into the container portion and the lids can be removed leaving the lid mount behind in the container. An example of this lid mount is shown in the Figures.

As used herein the term "rectangular container lid portion" refers to a lid that has a length and a width and corner shapes that matches the open top perimeter of the container and further comprises a pivotal hinge which traverses the width of the lid portion, wherein the lid removably mounts on the container portion using a lid mount adapted to receive the pivotal hinge. There may, in one embodiment, be tabs on the lid for lifting the lid to an open position. This can be seen in one embodiment in the Figures. There can also be tabs on the lid positioned to prevent the lid from moving horizontally as also shown. In one embodiment the lid is stiffened by the addition of one or more ribs. The ribbing is a longitudinal thickening or cross ridge thickening which stiffens the overall lid, especially where there are larger sizes.

As used herein the term "latches" refers to locks positioned at opposite ends of the hinge (on the long sides of the lid) designed to removably attach the lid to the container. An example of the latches is seen in the Figures.

Now referring to the Figures, FIG. 1 is a perspective view of the container insert of the present invention. The container insert 1 is designed to be inserted in a suitcase. It consists of a rectangular container portion 2 and a rectangular container lid portion 3. The lid portion 3 has a first pivotal hinge 5, a second hinge 9 and has reinforcing ribs 4. It is noted that in this version, the lid 3 is made of a transparent plastic. In this view there are a series of receiving slots 7 for accepting a divider panel 10. While the divider panels 10 are shown longitudinally they can be placed across the inside of the container portion 2. This view shows handles 6 which are folded down upon lid 3 to hold close the lid while latches 8 at the opposite ends of hinge 5 help hold the lid in position.

Figure 2:
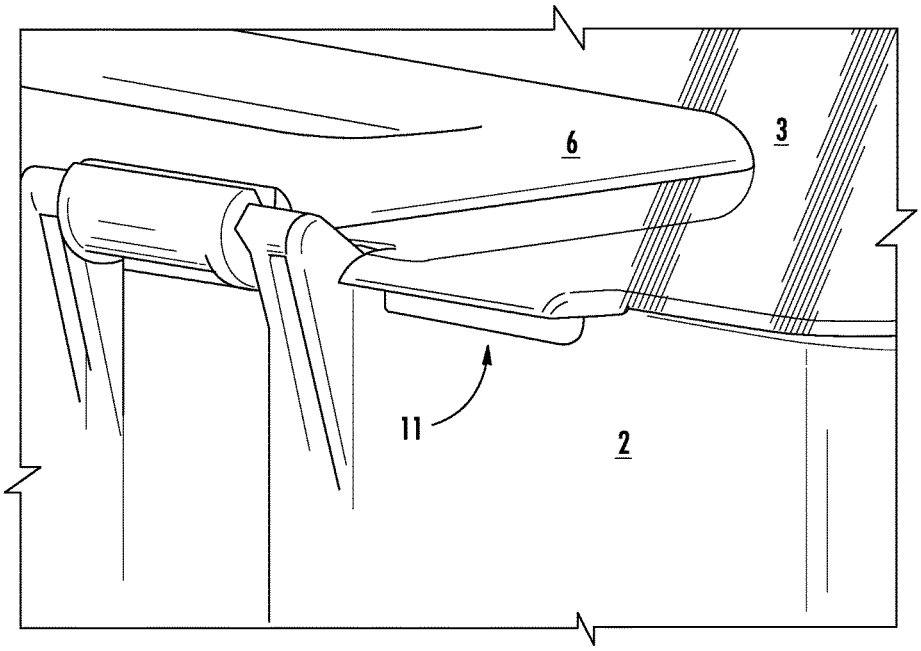
FIG. 2 is a close up of the tabs.
Figure 3:
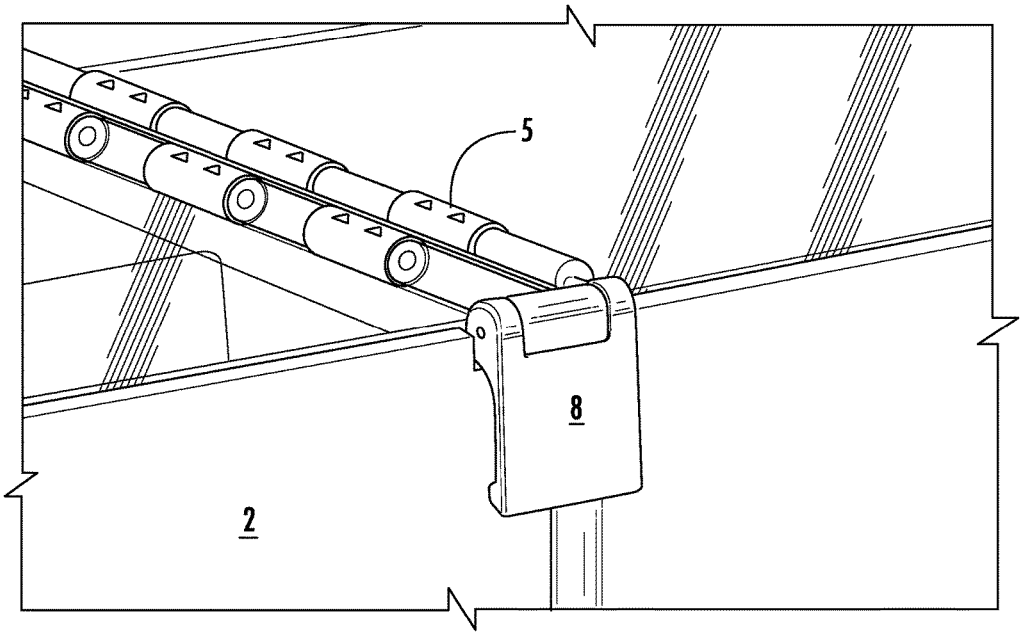
FIG. 3 is a close up of the latches.
Figure 4:
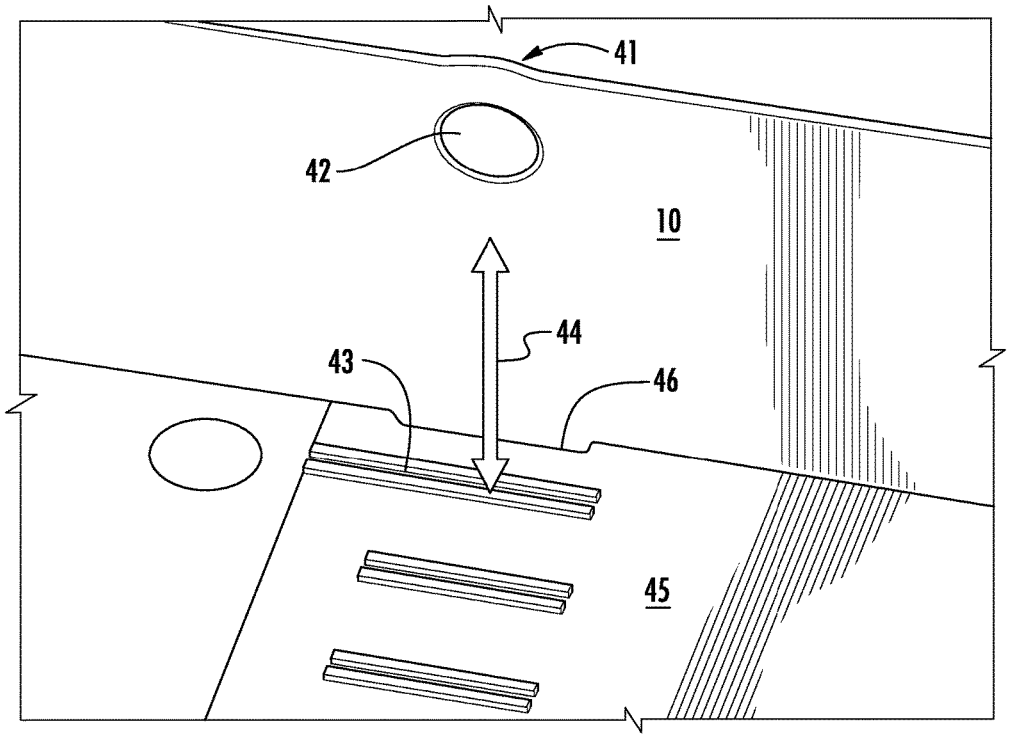
FIG. 4 is a perspective of a divider panel.

FIG. 2 is a perspective close-up view of tabs 11 that work in conjunction with handle 6 to keep the lid from pulling inward when the contents of the container portion 2 are pushing upward on the lid 3. FIG. 3 is a close up perspective of latch 8 at the end of hinge 5. FIG. 4 shows a divider panel 10 being installed/removed 44. The divider panel 10 moves downward and tab 46 fits into a snap-fit hole in the floor 45 of the container 2 to keep it securely in place. Also, seen in this view is bump 41 for supporting lid 3 and finger hole 42 to aid in removal of the panel 10.

Figure 5A:
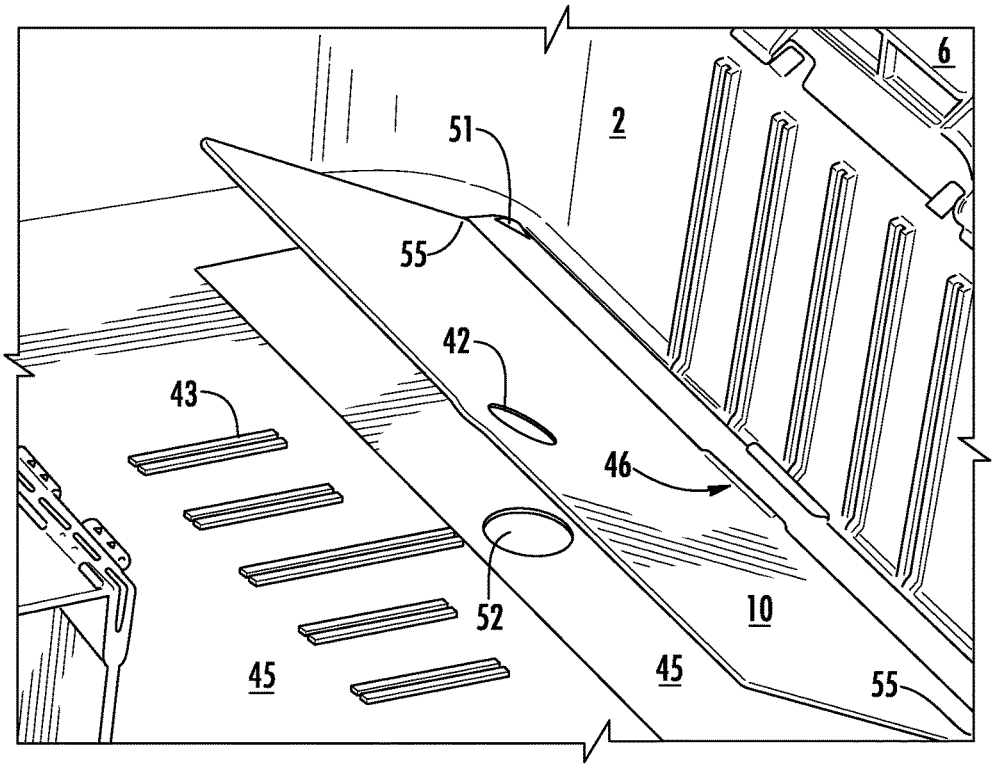
FIG. 5*a* and FIG. 5*b* shows a storing of a divider panel.
Figure 5B:
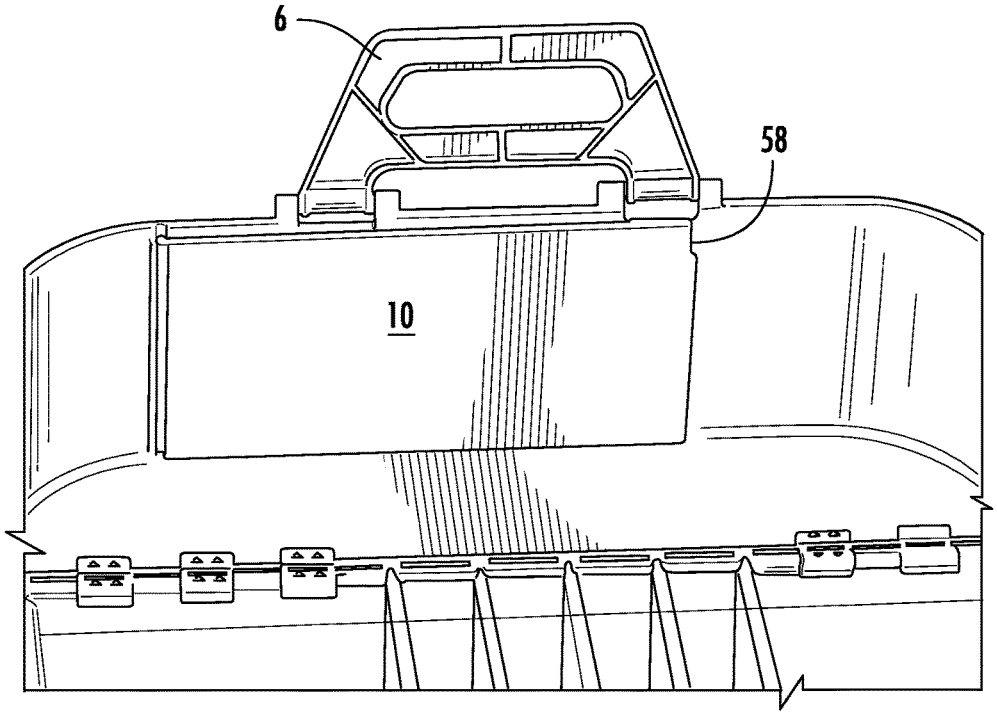
Figure 6:
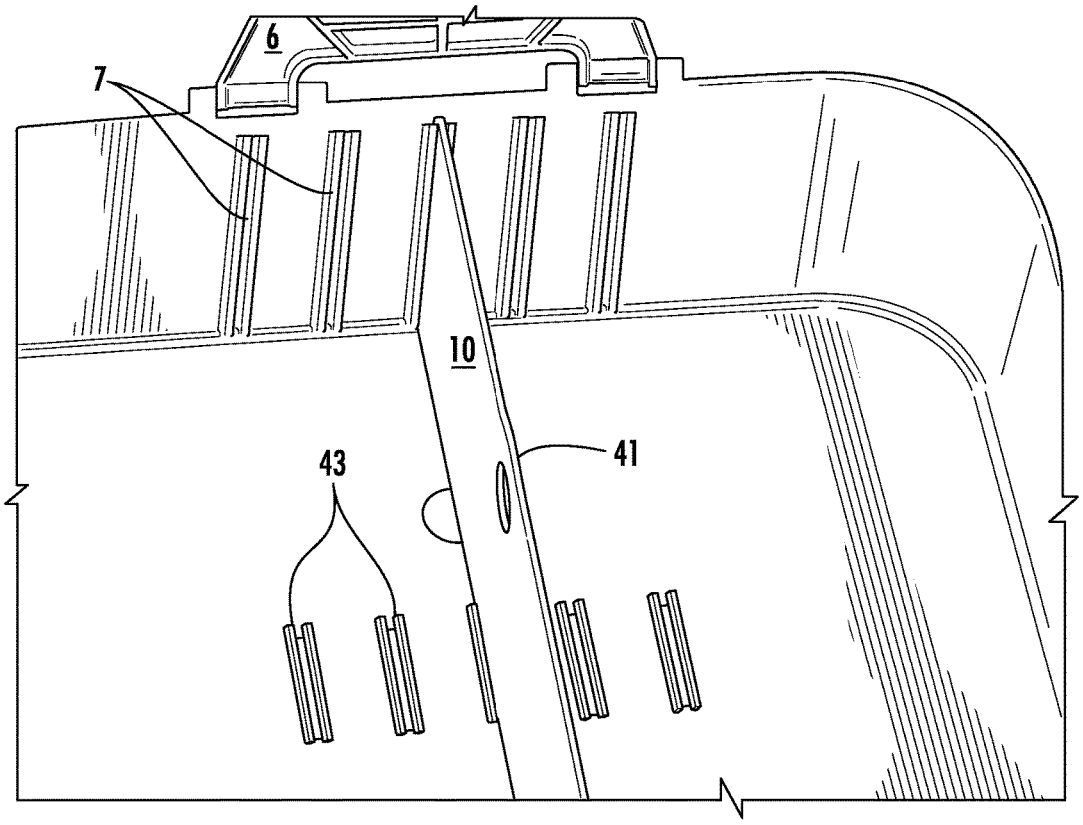
FIG. 6 shows an installed divider.

FIG. 5*a* shows the retention/stowing of a divider panel 10 when not in use. In this view three small gaps 51 (only two shown) positioned where the sides and floor of container 2 meet and accept the tab 46 and the two corners 55 of the divider 10 as the divider 10 is laid flat on the bottom 45 of container 2. In a further embodiment finger hole 42 of the divider aligns with finger hole 52 in floor 45 for easy removal of divider 10 when in the stowed configuration. FIG. 5*b* shows another storage configuration for the divider 10. In this view the divider 10 stands upright and is held in place by a snap 58 in the wall of the container portion 2. FIG. 6 is a perspective view of a portion of the inside of the container portion 2 showing the divider 10 installed in slots 7.

Figure 7:
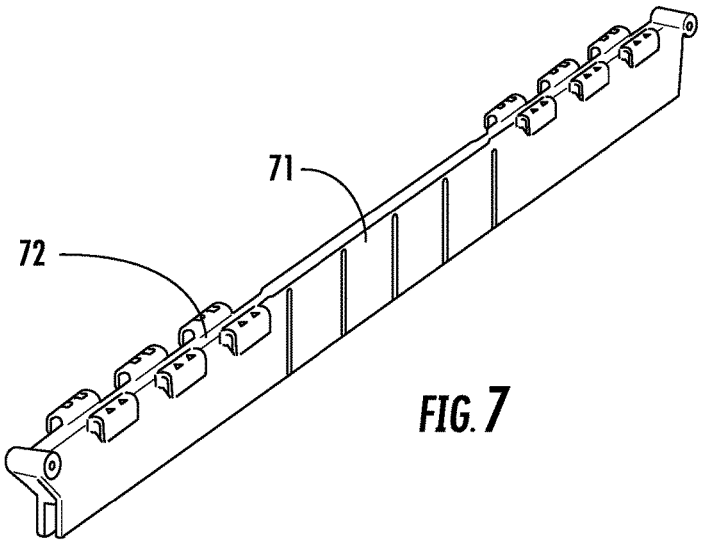
FIG. 7 shows the lid mount.

FIG. 7 shows a lid mount 71 for mounting a two piece lid. The half hinges 72 mate with half hinges in the lid 3 such that either half of the lid can open and close independent of one another. The lid mount 71 can be tall or short and hollowed out to aid in holding and weight. In one embodiment it fits into a lid mount acceptor shown in the next figure.

Figure 8:
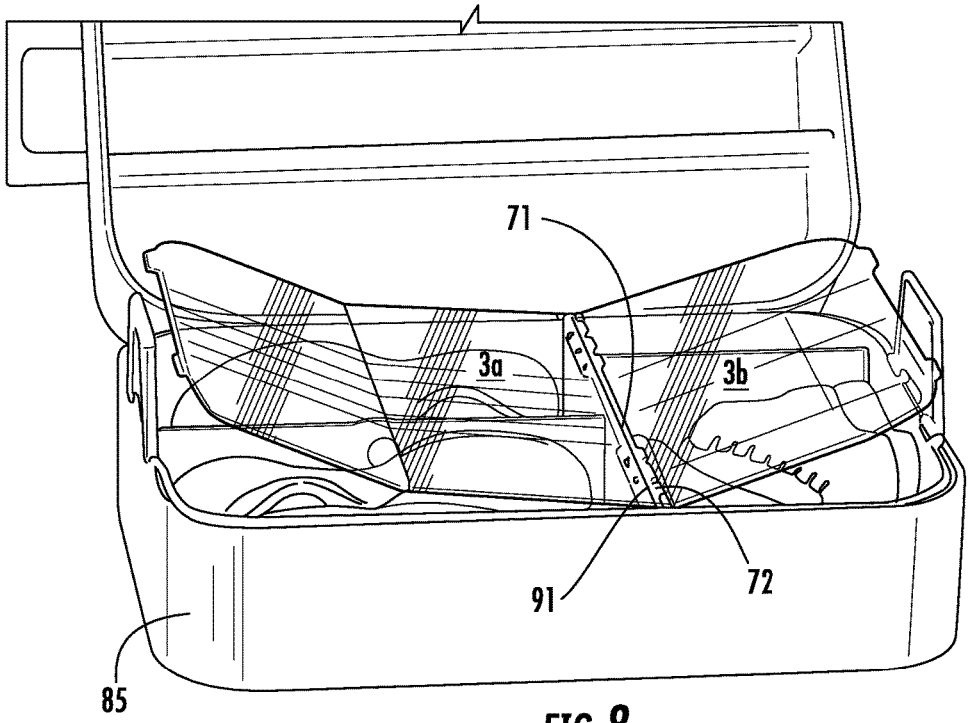
FIG. 8 is a perspective of the container inside a suitcase.
Figure 9:
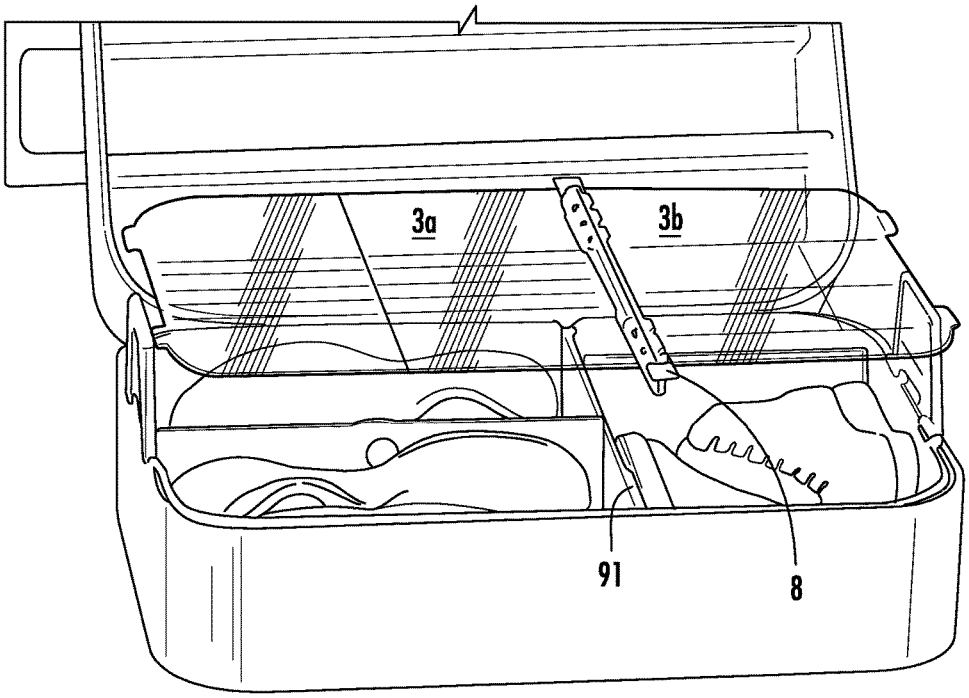
FIG. 9 is an exploded container inside a suitcase.

FIG. 8 is a perspective view of a container insert inside a suitcase 85 the lid is shown as half 10*a* and 10*b* which fold up independent and are attached to lid mount 71. FIG. 9 is an exploded perspective view showing the removal of lid halves 10*a* and 10*b* as a single piece. In this view, lid mount 71 is mounted on lid mount acceptor 91.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials and the like apparent to those skilled in the art still fall within the scope of the invention as claimed by the Applicant.

what is claimed is:

1. A container insert for use inside a suitcase that has an inside depth and also has an inside length, width, and corner shape defining an open top perimeter, the container insert comprising:

a) a rectangular container portion having a bottom and having a length and width side walls and a corner shape which define an open top perimeter the container insert made of a rigid polymer material and further comprising:
   i. a rectangular container insert lid portion;
   ii. a pair of handles pivotally mounted to opposite side walls of the container which fold flat onto the rectangular container insert lid portion; and
   iii. receiving slots on an inside surface of the side walls for removably receiving a divider panel;

b) the rectangular container insert lid portion having a length and a width and a corner shape that matches the open top perimeter of the container insert and further comprises: a pivotal hinge between a first and second section of the rectangular container lid portion which traverses the width of the lid portion wherein the lid removably mounts on the container portion using a mount on each end of the hinge which is adapted to attach to the container portion along each length of the container portion and a second hinge between the second section and a third section which traverses the width of the lid portion wherein the second hinge does not attach to the container portion; and c) at least one removable divider panel for positioning in the receiving slots.

2. The rectangular container portion according to claim 1 wherein the handles fold down on the rectangular container lid portion and hold it closed.

3. The container insert according to claim 1 wherein the rectangular container insert lid portion is made of a rigid polymer.

4. The container insert according to claim 3 wherein the rectangular container insert lid portion is a transparent polymer.

5. The container insert according to claim 1 wherein there are tabs on the rectangular container insert lid portion for lifting the lid to an open position.

6. The container insert according to claim 1 wherein there are tabs on the rectangular container insert lid portion to prevent the lid from moving horizontally.

7. The container insert according to claim 1 wherein the rectangular container insert lid portion is stiffened by the addition of ribbing.

8. The container insert according to claim 1 wherein the lid mount further has receiving slots for receiving removably the divider panel.

9. The container insert according to claim 1 wherein there are a pair of latches at opposite ends of the hinge on the rectangular container insert lid portion designed to removably attach the rectangular container insert lid portion to the container portion.

10. The container insert according to claim 1 wherein at least one of the at least one divider has a tab on a bottom edge which snap fits into a hole in the bottom of the container portion.

11. The container insert according to claim 10 wherein there are three small gaps in the container portion where the sides and bottom of the container portion meet, shaped to accept a divider removably in at least one position of lying flat and standing vertical in the container portion.

12. The container insert according to claim 1 wherein there is a bump on a top edge of one or more dividers positioned to support the rectangular container insert lid portion when the divider is being used and the lid is closed on the divider.

13. The container insert according to claim 1 wherein the open top perimeter of the container portion is the same shape as the open top perimeter of the suitcase and the container insert has an outside depth equal or less than the inside depth of the suitcase and wherein the container insert fits inside the suitcase with no more than about a one inch clearance between any inside wall of the suitcase and an adjacent outside wall of the container insert when the container insert is centered inside the suitcase.

14. The container insert according to claim 1 which is positioned inside the suitcase.

15. The container insert according to claim 1 wherein there is an internal partition traversing a width of the container portion positioned such that it is directly below a container lid mount when the lid is in place on the container portion.

16. The container insert according to claim 1 wherein there is one or more hinge in a container lid, in addition to the hinge on the lid mount.

17. The container insert according to claim 1 wherein there is a lid mount traversing the width of the side walls adapted to receive a pivotal hinge traversing the width of a rectangular container lid portion.

18. The container insert according to claim 1 wherein there is a hinge formed by mounting the rectangular container insert lid portion into a lid mount.

19. The container insert according to claim 1 wherein the pivotal hinge is slotted beneath the hinge in order to accept a top ridge of a divider.

* * * * *